United States Patent [19]

Lassiter

[11] Patent Number: 5,016,653

[45] Date of Patent: May 21, 1991

[54] METHOD AND APPARATUS FOR MANUFACTURING CIGARETTE RODS FREE OF METAL

[75] Inventor: Wallace R. Lassiter, Winston-Salem, N.C.

[73] Assignee: R. J. Reynolds Tobacco Company, Winston-Salem, N.C.

[21] Appl. No.: 900,015

[22] Filed: Aug. 25, 1986

[51] Int. Cl.[5] ..... A24C 5/00

[52] U.S. Cl. ..... 131/286; 131/280; 131/84.1

[58] Field of Search ..... 131/280, 84.1, 286, 131/290

[56] References Cited

U.S. PATENT DOCUMENTS 3,854,587 12/1974 McLoughlin et al. ..... 209/
4,350,170 9/1982 Baier ..... 131/
4,474,190 10/1984 Brand .
4,616,139 10/1986 Heitmann ..... 290/
4,707,652 11/1987 Lowitz .

FOREIGN PATENT DOCUMENTS 0086107 8/1983 European Pat. Off. .

OTHER PUBLICATIONS

Keyence Corp. Brochure, "Proximity Sensors".

*Primary Examiner*—V. Millin

[57] ABSTRACT

Cigarette rods having fragments of metal therein can be efficiently and effectively separated from cigarette rods free of detectable metal particulates. A moving continuous rod exiting a rod-forming unit passes through a ring-like metal sensing device. The continuous rod is subdivided into individual rods of the desired length. A reject valve operates to isolate any rods determined to contain metal fragments. The process is performed to provide high quality control in the manufacture of cigarettes.

1 Claim, 1 Drawing Sheet

METHOD AND APPARATUS FOR MANUFACTURING CIGARETTE RODS FREE OF METAL

BACKGROUND OF THE INVENTION

This invention relates to the manufacture of rod-like articles, and in particular to such articles useful in the manufacture of cigarettes.

Cigarettes are rod-like articles including a circumscribing wrap such as paper enveloping strands of smokable material such as tobacco. Particularly popular cigarettes include a tube-like circumscribing wrap containing strands of a blend of various tobaccos thereby forming a rod having a circular cross section. Such rods are conventionally referred to as "tobacco rods." Typical cigarettes are manufactured from tobacco rods having lengths ranging from about 55 mm to about 85 mm, and circumferences ranging from about 19 mm to about 27 mm.

Tobacco rods are manufactured using commercially available rod making units. Generally, strands of a blend of tobacco (i.e., tobacco filler) is continuously fed onto a moving web of cigarette wrapping material from a bobbin. The moving web is transported through a rod-forming unit by a garniture conveyer belt. Within the rod-forming unit, the wrapping material is positioned so as to envelope the tobacco filler, and the wrapping material is secured into a tube-like shape by applying an adhesive to the lap zone thereof. The continuous rod so provided is transported from the rod-forming unit to a subdividing means where the continuous rod is cut at the desired lengths to provide a plurality of rods. The plurality of tobacco rods are subjected to further processing steps in order to provide the final cigarette product.

During the processing and transport of tobacco filler to the rod-forming unit, certain undesirable impurities can come into contact therewith. For example, foreign matter such as metal particulates can be present in the tobacco filler, and consequently can be incorporated into the resulting tobacco rods. Having metal impurities present in tobacco filler is highly undesirable in that there is provided added difficulty in manufacturing consistently high quality cigarette rods.

It would be highly desirable to provide an efficient and effective process for separating tobacco rods having particulate metallic impurities therein from the desirable, high quality tobacco rods essentially free of particulate metallic impurities.

SUMMARY OF THE INVENTION

In one aspect, this invention is an apparatus for separating rods of predetermined lengths and having detectable metal particulates therein from rods of predetermined lengths and substantially free of detectable metal particulates, the apparatus comprising:

(a) means for forming a moving continuous rod;

(b) means for sensing metal particulates within the moving continuous rod;

(c) means for dividing the moving continuous rod into a plurality of rods, each of predetermined length; and (d) means for isolating rods of predetermined lengths and containing detectable metal particulates therein in response to metal particulates sensed in the moving continuous rod.

In another aspect, this invention is a process for separating rods of predetermined lengths and having detectable metal particulates therein from rods of predetermined lengths and substantially free of detectable metal particulates, the process comprising:

(a) providing a moving continuous rod from a rod-forming unit; and (b) sensing metal particulates present in the moving continuous rod; and then (c) dividing the moving continuous rod into a plurality of rods, each of predetermined length; and then (d) isolating rods of predetermined lengths and containing detectable metal particulates therein in response to metal particulates sensed in the moving continuous rod.

Preferably, rods processed according to this invention are tobacco rods such as are employed in the manufacture of cigarettes.

The process of this invention is useful in isolating tobacco rods containing impurities such as fragments or pieces of wire, staples, nails, screws, metal shavings, metal filings, aluminum foil, solder, springs, sheet metal, needles, pins, tacks, and the like.

The process of this invention is useful in improving the quality control of tobacco rods. For example, tobacco rods containing metal impurities can be isolated from the high quality rods essentially free of metal impurities. Thus, the manufacturer of tobacco rods can employ the process and apparatus of this invention in order to assure that only high quality rods are shipped to the consumer.

The process of this invention provides a means for monitoring the quality of tobacco rods during manufacture whereby limited alterations to conventional rod-making apparatus are required. Preferably, the process can be performed without the necessity of providing elaborate shielding means which minimize the effects of surrounding metal machine parts, etc. In fact, the process can be performed essentially without any effects provided by surrounding metal machine parts. In addition, the isolation of the rods containing the detectable metal particulates can be performed such that the isolated rods can be employed in tobacco recycling operations.

DETAILED DESCRIPTION OF THE EMBODIMENTS

Figure 1:
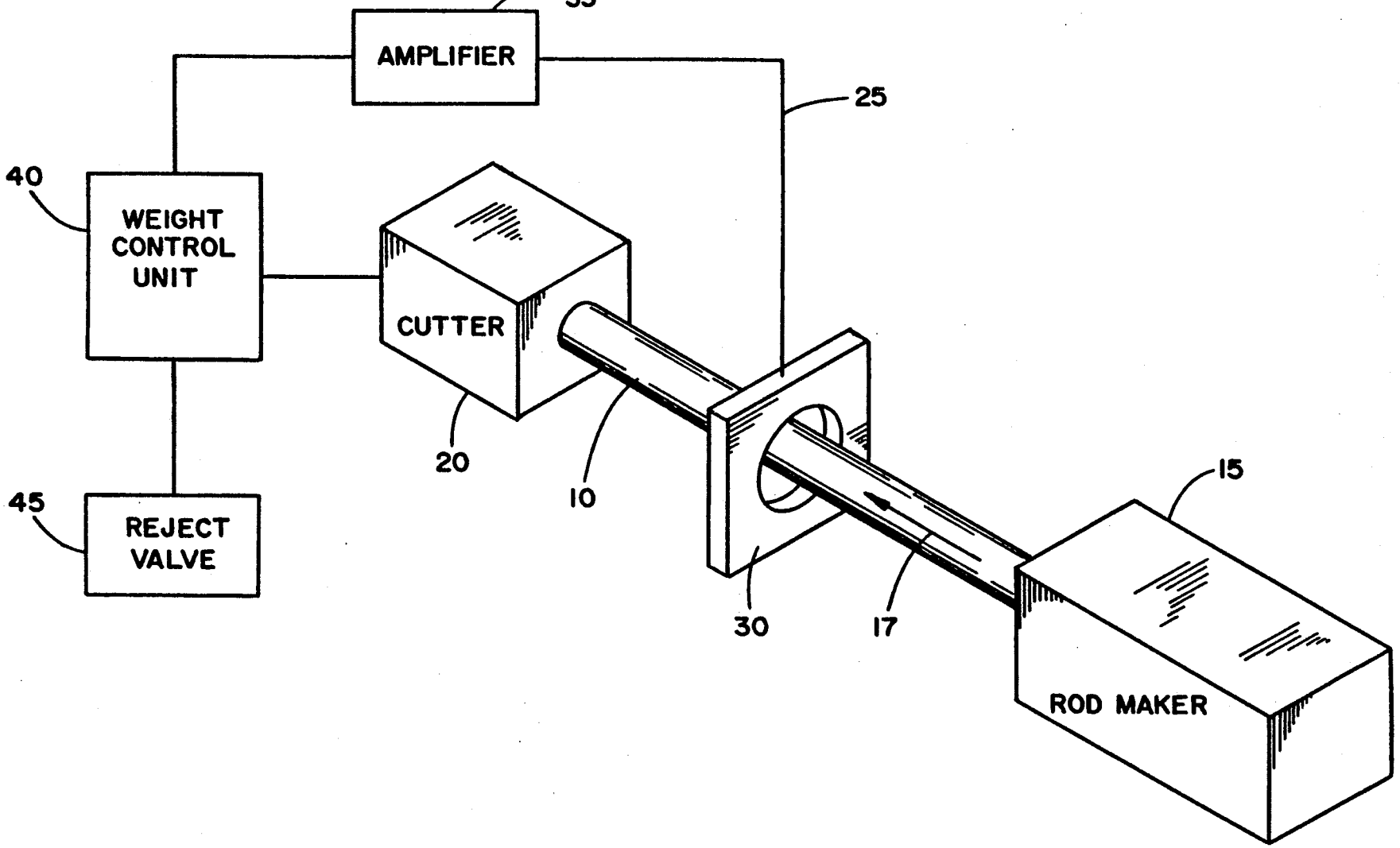
FIG. 1 is a schematic illustration of the various components including the rod-forming unit, the rod and the metal sensing means.

As used herein, the term "detectable metal particulates" is meant to include a wide variety of metallic materials. For example, metals can include copper, aluminum, iron, platinum, silver, as well as alloys thereof including brass, steel and stainless steel, and other such metallic materials. Additionally, by the term "detectable" is meant any metal particulate of a sufficient size to be sensed by the sensing means and detected as a foreign object within the rod. Typical detectable materials are of a small enough size to fit into the rod; and large enough to be detected and identified as a foreign object within the rod. Identification of the foreign metallic object can include visual identification of the object, an experienced change in taste and/or burn characteristic of the cigarette due to the presence of the metal object, or other such factor. For example, aluminum foil about 0.04 square inch, and 30 gauge steel wire about 0.25 inch in length, can be detected. As used herein, the term "particulates" is to be broadly construed to include particles, pieces of foil, strands of wires, fragments of metal articles, shavings, filings, and the like.

By the term "substantially free of detectable metal particulates" in referring to rods is meant an amount of metal particulates less than that level which can be identified as foreign matter within a tobacco rod. Whether a particular rod is substantially free of detectable metal particulates depends upon factors such as the level of detection of the metal particulates. For example, the level of detection can be relatively high in order that rods having very minute amounts of metal particulates of very minute size can be detected. Alternatively, the level of detection can be relatively low in order that rods having certain amounts of metal particulates of a certain size are not detected. The level of detection can be varied depending upon factors such as the desired level of quality control, or other such factors. For example, small sized metal particulates which are not readily identifiable to the naked eye, or which do not significantly or noticeably affect the taste or burn characteristic of a tobacco rod, can be non-detectable for purposes of this invention by providing a sensing means having a relatively low level of detection.

Referring to FIG. 1, a moving continuous rod 10 is manufactured in rod-forming unit 15. In particular, the rod-forming unit provides a continuous rod which moves in a linear direction therefrom. Suitable rod-forming units include commercially available rod-forming units for the manufacture of tobacco rods. Examples of suitable rod-forming units are available as components within commercially available cigarette rod-making machines such as Hauni Protos 8000 by Hauni-Werke Korber & Co. KG; Molins Mark IV by Molins Machine Co., Ltd., Deptford, England; as well as other such machines.

The moving continuous rod 10 exits the rod-forming unit 15, in the direction indicated by arrow 17, at a rate which can vary. In particular, the continuous rod is moving in a linear direction parallel to or along the longitudinal axis thereof. Typically, in the manufacture of cigarettes, the continuous tobacco rod is provided at a linear rate of about 200 to about 600, more typically at about 350 to about 500, meters per minute.

The moving continuous rod 10 is divided into a plurality of rods by subdividing means 20. Typically, the subdividing means is a circular cutter, or other means suitable for subdividing the continuous rod into a plurality of rods, each of predetermined length. Preferably, the subdividing means is controlled relative to the rate of movement of the continuous rod such that a plurality of rods, each of a discrete, predetermined length are provided. Suitable subdividing means 20 are commercially available as components within the previously described cigarette rod-making machines.

Sensing means 25 is capable of sensing metal particulates within the moving continuous rod 10. A conveniently useful sensing means includes a magnetic field variance device 30 having a ring-like shape such that the continuous rod 10 can pass therethrough while moving from the rod-forming unit 15 to the subdividing means 20. The ring-like machine field variance device 30 is connected to a detection means 35 such as an amplifier. The sensing means is operated in a manner such that a magnetic field is set up within the magnetic field variance device, and a metal particulate within the continuous rod moving through the hollow ring portion of the magnetic field variance device acts to provide a variance in the magnetic field. The variance in the magnetic field is provided by a metal particulate within the rod as sensed by the detection means 35. A suitable magnetic field variance device is a commercially available Keyence TA-310 Sensor Ring by Keyence Corporation. A suitable detection means is a commercially available Keyence MA-340 Amplifier by Keyence Corporation.

The detection means 35 of the sensing means 25 is connected to weight control device 40 which in turn includes a reject valve 45. Suitable weight control devices are commercially available as 7000 M. Accuray from Industrial Nucleonics Incorporated, Columbus, Ohio; and Hauni SRM Weight Control Unit from Hauni-Werke Korber & Co. KG. The connection of the detection means to the weight control unit provides the ability to isolate rods containing detectable metal particulates in response to the metal particulates sensed in the moving continuous rod. In particular, the metal particulate is sensed in the moving continuous rod, and a counter within the weight control device determines the time at which the subdivided rod reaches the reject valve. At the time that the subdivided rod containing the detectable metal particulate reaches the reject valve, the individual rod is ejected thereby isolating that rod from the remaining rods of predetermined lengths which are employed in further manufacturing and/or packaging stages.

What is claimed is:

1. An apparatus for separating rods of predetermined lengths and having detectable metal particulates therein from rods of predetermined lengths and substantially free of detectable metal particulates, the apparatus comprising:

(a) means for forming a moving continuous tobacco rod;

(b) magnetic field variance means for sensing metal particulates within the moving continuous tobacco rod, the magnetic field variance means including a detection means;

(c) means for dividing the moving continuous rod into a plurality of rods, each of predetermined length; and (d) means for isolating rods of predetermined lengths and containing detectable metal particulates sensed in the moving continuous rod, the means for isolating rods including a weight control device having a reject valve, said weight control device being connected to said detection means.

* * * * *